US010550509B1

(12) United States Patent
Kiesendahl

(10) Patent No.: US 10,550,509 B1
(45) Date of Patent: Feb. 4, 2020

(54) WEATHER RESISTANT OUTDOOR CLOTHES DRYER

(71) Applicant: Tifanny Kiesendahl, Hawley, PA (US)

(72) Inventor: Tifanny Kiesendahl, Hawley, PA (US)

( * ) Notice: Subject to any disclaimer, the term of this patent is extended or adjusted under 35 U.S.C. 154(b) by 78 days.

(21) Appl. No.: 15/969,859

(22) Filed: May 3, 2018

(51) Int. Cl.
*D06F 58/20* (2006.01)
*D06F 58/04* (2006.01)

(52) U.S. Cl.
CPC ..... *D06F 58/20* (2013.01); *D06F 58/04* (2013.01)

(58) Field of Classification Search
CPC ..... D06F 58/00; D06F 58/20; D06F 58/04; F26B 5/00; F26B 11/00; F26B 21/00
USPC ..... 34/201
See application file for complete search history.

(56) References Cited

U.S. PATENT DOCUMENTS 2,389,724 A * 11/1945 Falco ..... A47K 3/284 52/264
2,407,738 A * 9/1946 Falco ..... A47K 3/02 4/584
4,197,684 A * 4/1980 Johnson ..... A01G 9/28 52/102
4,754,852 A * 7/1988 Mule ..... H04R 1/02 181/144
5,826,373 A * 10/1998 Mrdjenovich ..... A01G 9/28 47/33
6,132,820 A * 10/2000 Callahan ..... B28B 7/007 427/307
6,168,290 B1 1/2001 Christiansen
6,851,228 B1 * 2/2005 Forman ..... E04H 4/0018 52/80.1
7,210,245 B1 * 5/2007 Galli ..... F26B 9/003 34/201
7,343,910 B2 * 3/2008 Tocheniuk ..... F23D 3/16 125/1

(Continued)

FOREIGN PATENT DOCUMENTS

CN 2637895 Y 7/2003
DE 102007032013 B4 * 5/2012 ..... C02F 11/10

(Continued)

OTHER PUBLICATIONS

Woodford, Chris, "Clothes dryers," Explain That Stuff, Nov. 5, 2017, http://www.explainthatstuff.com/how-clothes-tumble-dryers-work.html.

(Continued)

*Primary Examiner* — Stephen M Gravini
(74) *Attorney, Agent, or Firm* — Gugliotta & Gugliotta LPA

(57) ABSTRACT

A weather-resistant outdoor dryer is provided consisting essentially of: a simulated rock cabinet enclosure assembly; and a dryer appliance integrated within the enclosure. The simulated rock cabinet enclosure assembly is formed to provide an overall outer appearance consistent with that of a landscaping hardscape element such as a boulder. The boulder may be formed of a molded, hollow simulated stone cabinet or enclosure having an opening and a relatively large cavity or chamber forming an internal appliance containment well within which the dryer appliance is mounted. The instant abstract is neither intended to define the invention disclosed in this specification nor intended to limit the scope of the invention in any way.

12 Claims, 6 Drawing Sheets

(56) References Cited

U.S. PATENT DOCUMENTS

| | | | | |
|---|---|---|---|---|
| 7,600,991 | B1 * | 10/2009 | Schofield | B44C 3/046 425/267 |
| 8,413,397 | B2 * | 4/2013 | Lacas | B44C 5/06 52/311.1 |
| D761,156 | S * | 7/2016 | Thomason | D11/149 |
| 10,159,314 | B2 * | 12/2018 | Kirth | A44C 17/02 |
| 10,231,039 | B2 * | 3/2019 | Soofer | H04R 1/025 |
| 2012/0191023 | A1 * | 7/2012 | Young | A61F 7/034 601/18 |
| 2016/0316823 | A1 * | 11/2016 | Licenziato Monti | A41B 3/02 |
| 2018/0070722 | A1 * | 3/2018 | Yang | A47B 83/00 |

FOREIGN PATENT DOCUMENTS

| | | | | |
|---|---|---|---|---|
| GB | 191308646 | A * | 1/1914 | D06F 45/00 |
| WO | WO-2011008010 | A3 * | 3/2011 | B01J 9/10 |

OTHER PUBLICATIONS

Paretts, Susan, "The Average Washer & Dryer Dimension", Hunker, https://www.hunker.com/13410096/the-average-washer-dryer-dimensions.

* cited by examiner

WEATHER RESISTANT OUTDOOR CLOTHES DRYER

RELATED APPLICATIONS

There are no previously filed, nor currently any co-pending applications, anywhere in the world.

BACKGROUND OF THE INVENTION

1. Field of the Invention

The present invention relates generally to dryers and, more particularly, to weather-resistant dryers for outdoor use.

2. Description of the Related Art

Beach towels are common around public pools and private pools alike, and provide a much quicker solution than air drying oneself. However, it is less than ideal to get out of a pool and have a damp, limp, cold towel, which can happen if one is going in and out of a pool several times in a day.

One solution to this problem could be to have multiple towels per person. However, this solution causes more work by requiring the swimmer to wash more towels at the end of the night than necessary.

A clothes dryer is a home appliance usually used in conjunction with a washing machine. The user washes their clothes in the washing machine, but the washing machine turns out clothes that are wet. Historically, people would wash their clothes and have to allow the clothing to air dry. A dryer, however, is a contemporary appliance that speeds up the evaporation process and allows one to dry wet clothing quickly.

To efficiently dry clothes, a dryer uses heat to turn the liquid water in the clothing into water vapor, thus evaporating the liquid water and leaving behind dry clothes.[1] These machines pump hot air into the interior cavern, which simultaneously rotates so as to cause the contents to tumble while the hot air is being provided.[1] Dryers use an air intake to draw cold air into the machine, and use a motor-powered fan to pull the cold air towards a heating element, where it is warmed and transformed into hot, dry air.[1]

An internal thermostat is typically provided in order to shut off the heating element periodically.[1] This is done in an effort to prevent over heating of the machine and to prevent the clothes, which are usually made of natural fibers such as cotton, from over heating and becoming damaged.[1] Some dryers include functionality to alter the thermostat setting by setting a lower or higher maximum temperature.[1] Once the air is warmed, it enters the internal, cavernous drum through holes in the drum.[1]

When operating, the machine slowly rotates the drum used an electric-powered belt that is typically made of rubber. The drum often features various protruding paddles within its interior.[1] As the drum rotates, these paddles lift and tumble the clothing contents to the top of the drum, where gravity then pulls the contents back down.[1] During this fall, the clothes pass through the hot, dry air that is flowing within the drum.[1] This helps to quickly dry the clothing and evaporate the liquid water.[1]

The air, once warm and dry but now humid, then exits the dryer and passes through a lint-filer on its way out.[1] This filter collects dust and pieces of fabric that have been dislodged.[1] These lint-filtered must be cleaned regularly to prevent fire hazards.[1] The humid, wet air is then exhausted from the machine using a vent hose.[1]

More modern dryers will use a heat exchanger apparatus.1 The humid air passes through heat exchanger on its way out of the machine, cooling the air and collecting any remaining heat to reuse that heat, making the process more energy-efficient.[1]

Traditionally, dryers are large machines. Even the compactly designed dryers are, on average, 24 inches wide, 22-24 inches deep, and 33-34 inches tall.2 Furthermore, given the complex electrical nature of the dryer, it has traditionally been an indoor appliance not capable of withstanding inclement weather.

It is preferable that a dryer be modified to provide weather-resistance to allow for outdoor, pool-side use. This preferred weather-proof outdoor dryer should also be disguised as a rock so as to seamlessly blend in in close proximity to a pool and without becoming an aesthetic distraction and otherwise displeasing. This outdoor dryer would be capable of being powered by traditional AC currents, as well as capable of capturing and converting solar energy through the use of solar panels, and additionally capable of being powered through batteries. These alternate power-source options will allow for universal compatibility with various pool side and outdoor atmospheres. This preferable outdoor, weather-resistant dryer would allow for one to dry their towel while they swim, thus ensuring a warm, dry, comfortable towel when they exit the pool.

SUMMARY OF THE INVENTION

It is thus an object of the present invention to provide a weather-resistant, outdoor dryer.

It is a feature of the present invention to provide three alternative power sources: (1) battery-power; (2) solar power via solar panels affixed to the exterior of the invention; (3) AC current power.

It is a feature of the present invention to provide a drum-and-paddle internal cavern for holding towels and clothing, which is moved by a motor to rotate.

It is a feature of the present invention to provide an air intake valve to capture air, where after the air passes through a thermostat-regulating heating element and eventually through the internal drum cavern.

It is a feature of the present invention to contain this apparatus within a faux-boulder exterior for concealing a dryer's traditionally otherwise aesthetically displeasing exterior when placed poolside or outdoors.

The present invention provides a system and method for drying towels and clothes outdoors.

Further objects, features, elements and advantages of the present invention will become readily apparent from the following detailed description of the preferred embodiment when considered with the attached drawings and the appended claims.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
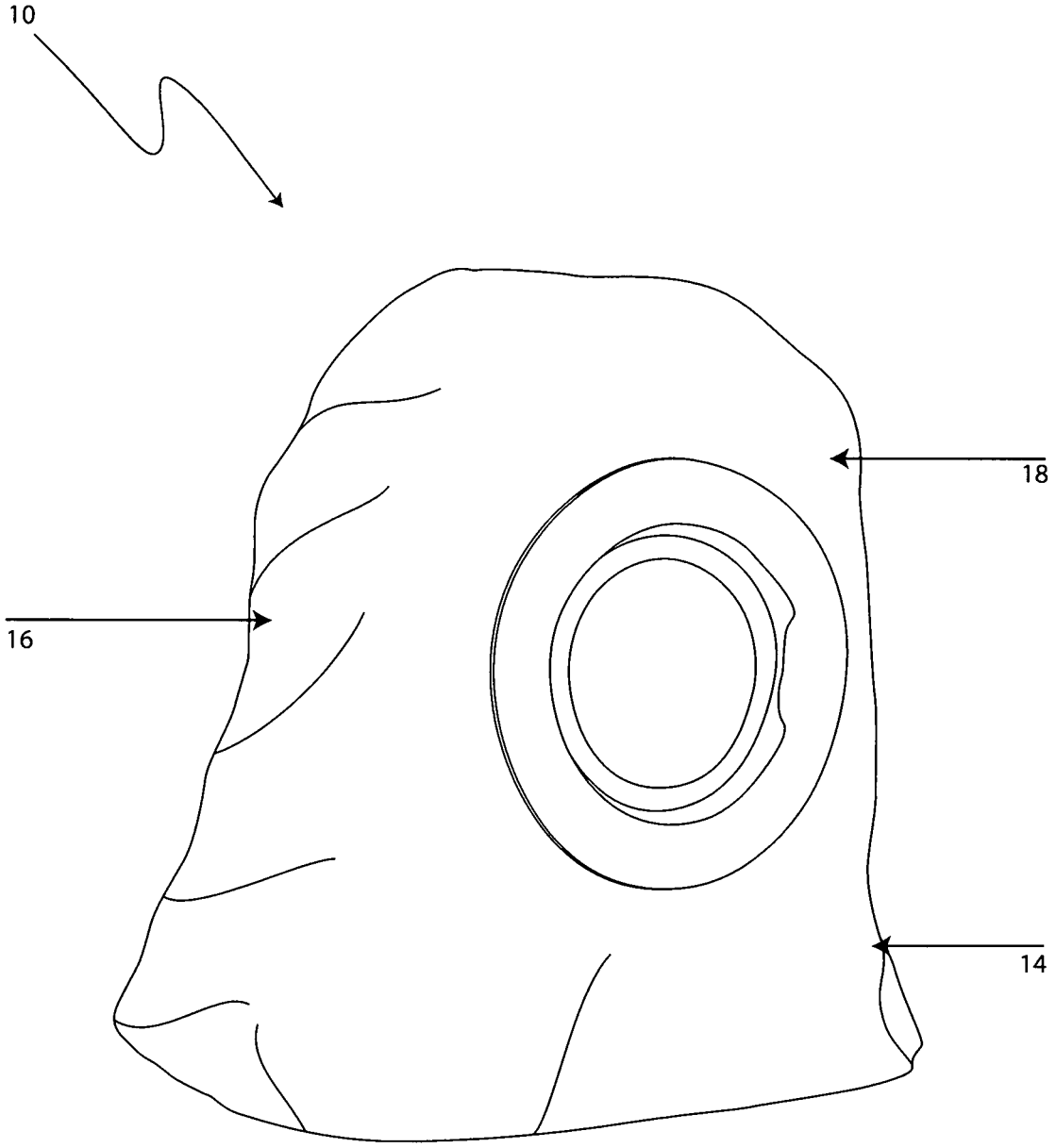
FIG. 1 depicts a block drawing of a weather-resistant outdoor dryer from a frontal perspective.
Figure 2:
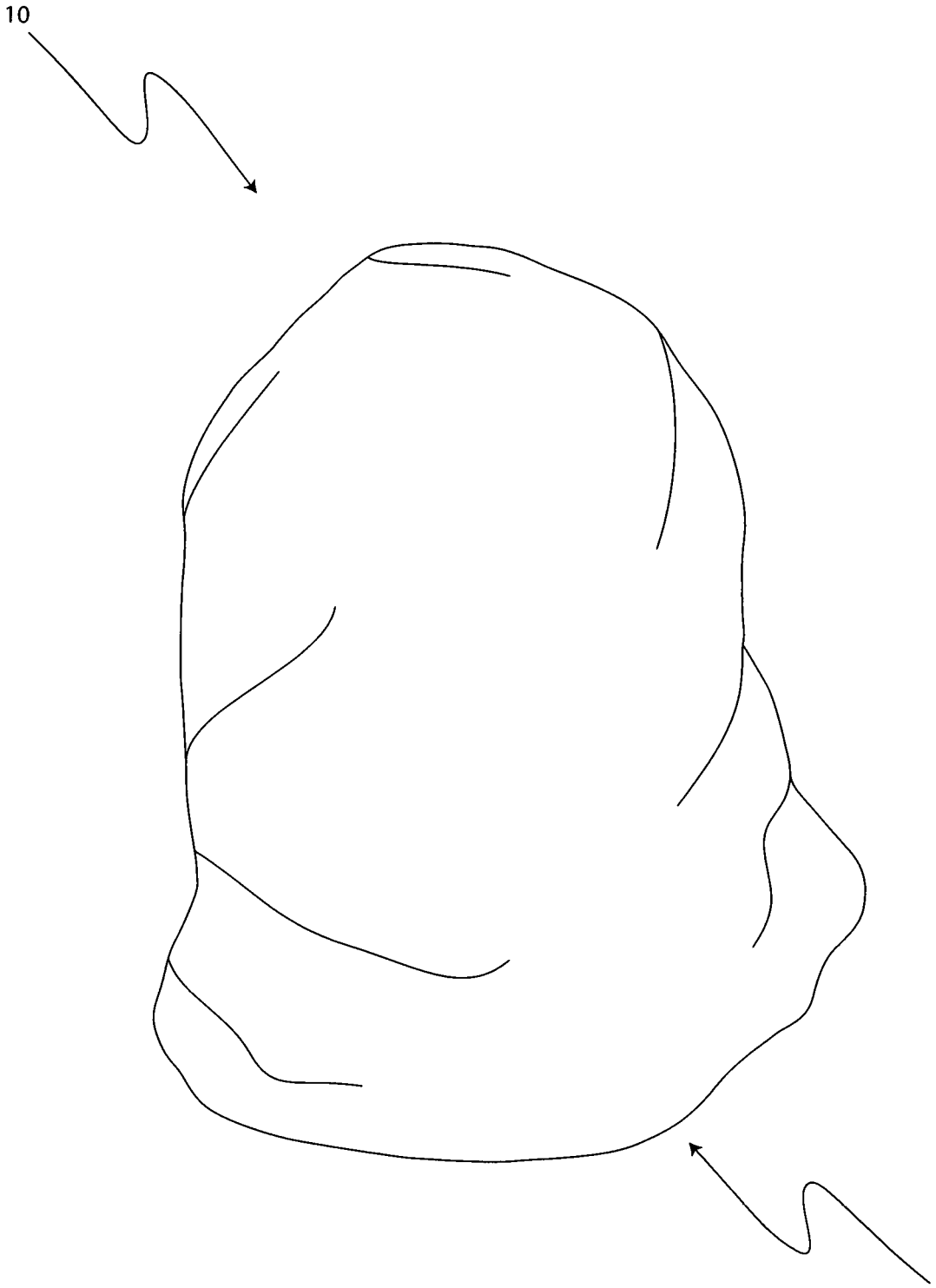
FIG. 2 provides the same from a rear perspective.
Figure 3:
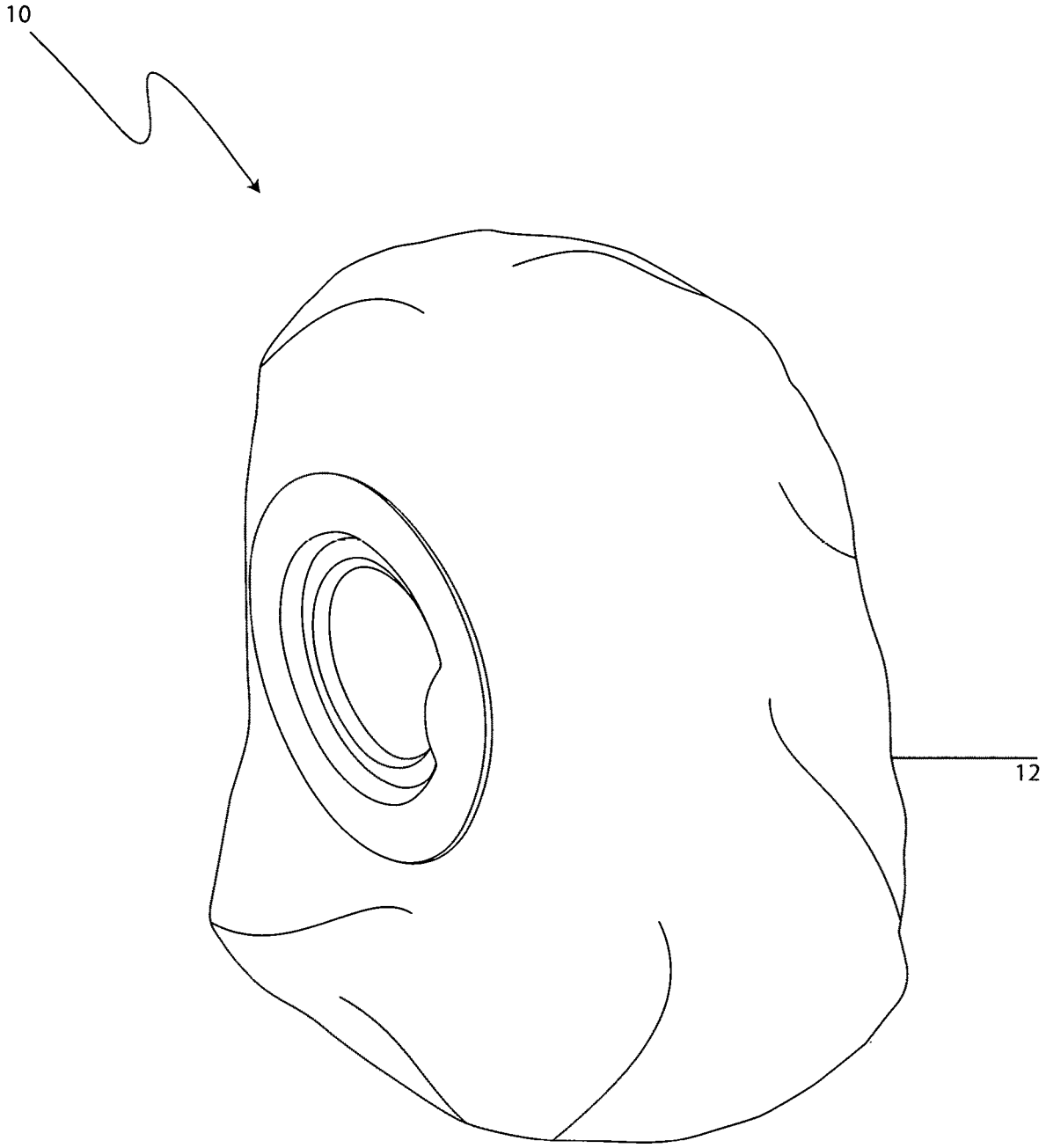
FIG. 3 provides the same from a side profile perspective.
Figure 4:
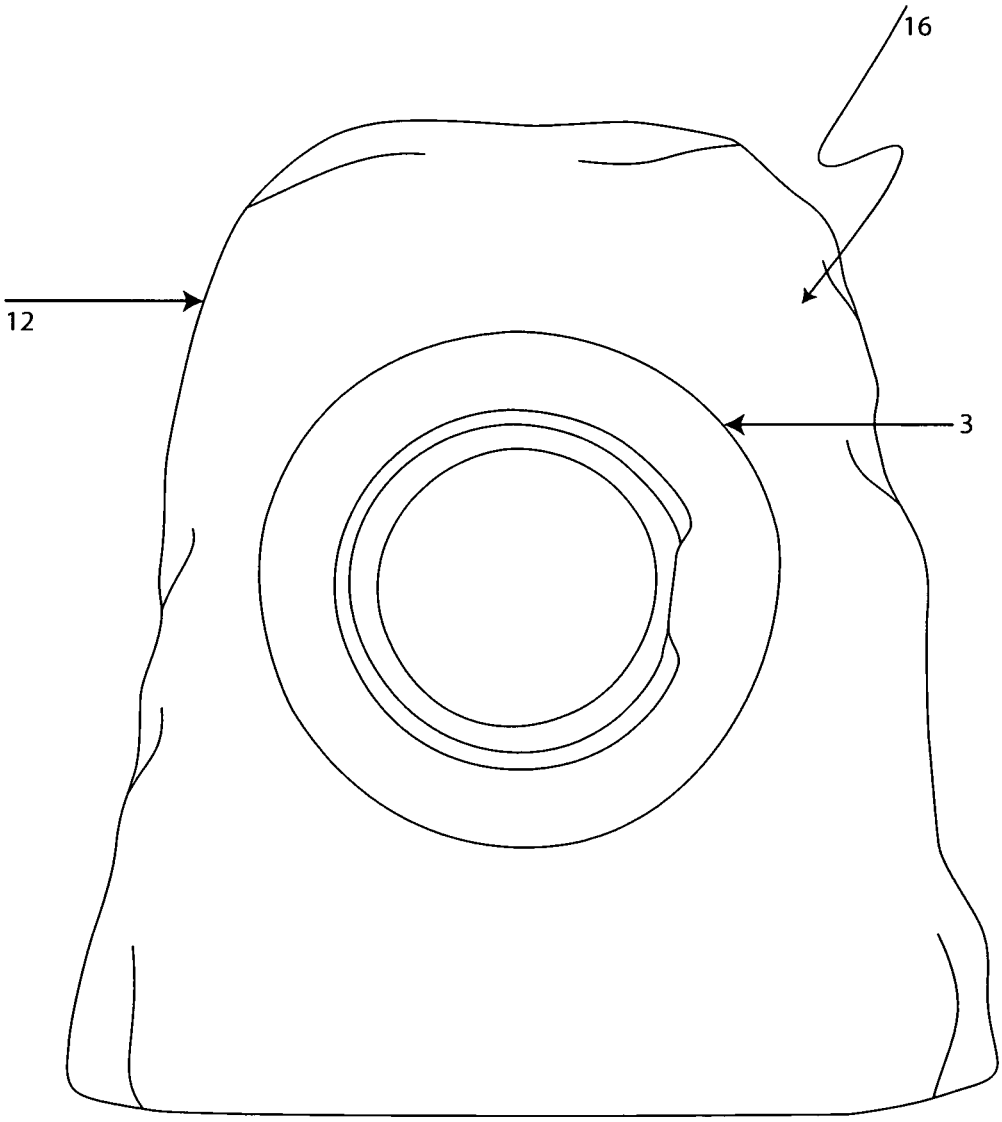
FIG. 4 provides the same from a front-facing perspective.
Figure 5:
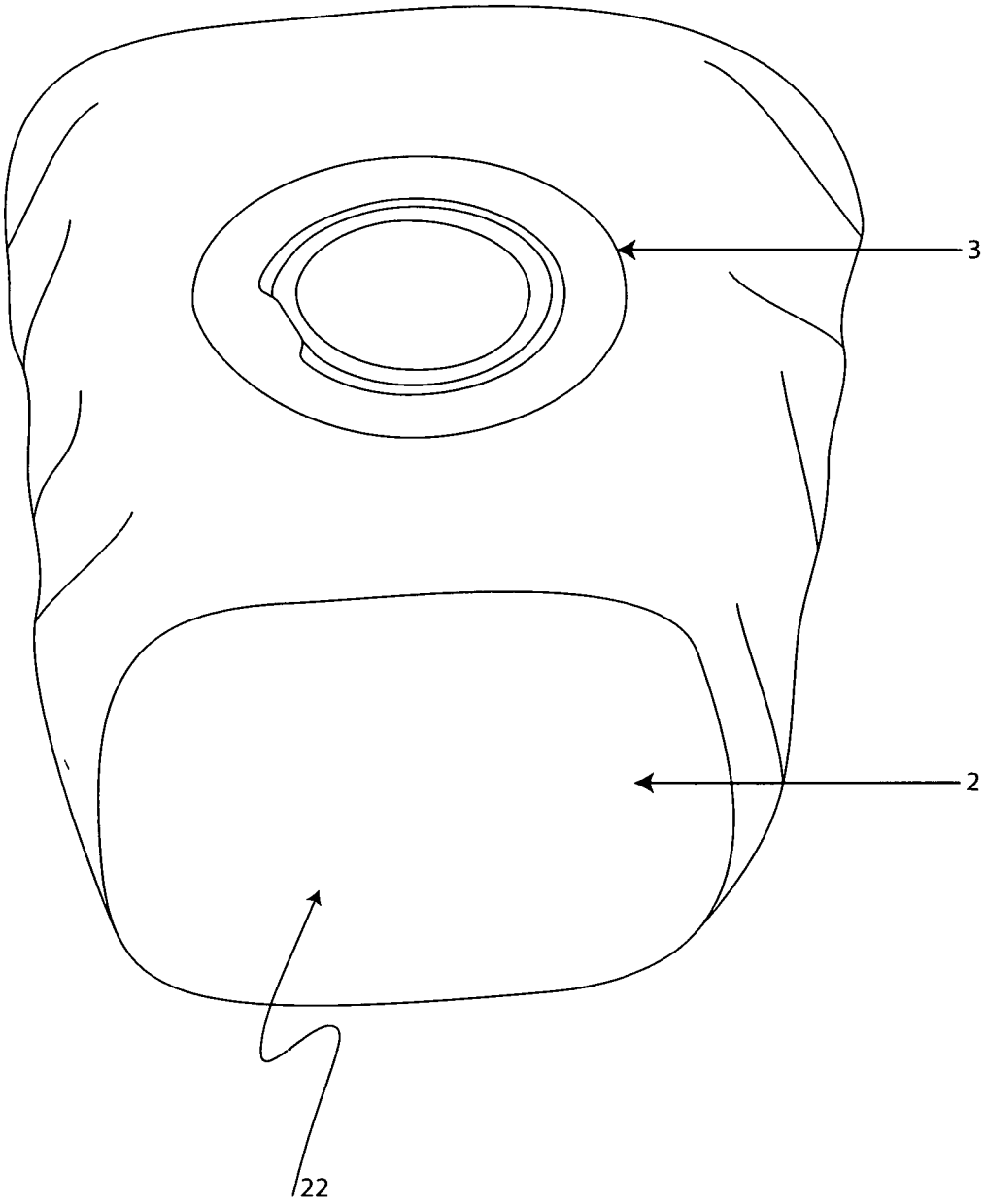
FIG. 5 provides the same from a top-down perspective.
Figure 6:
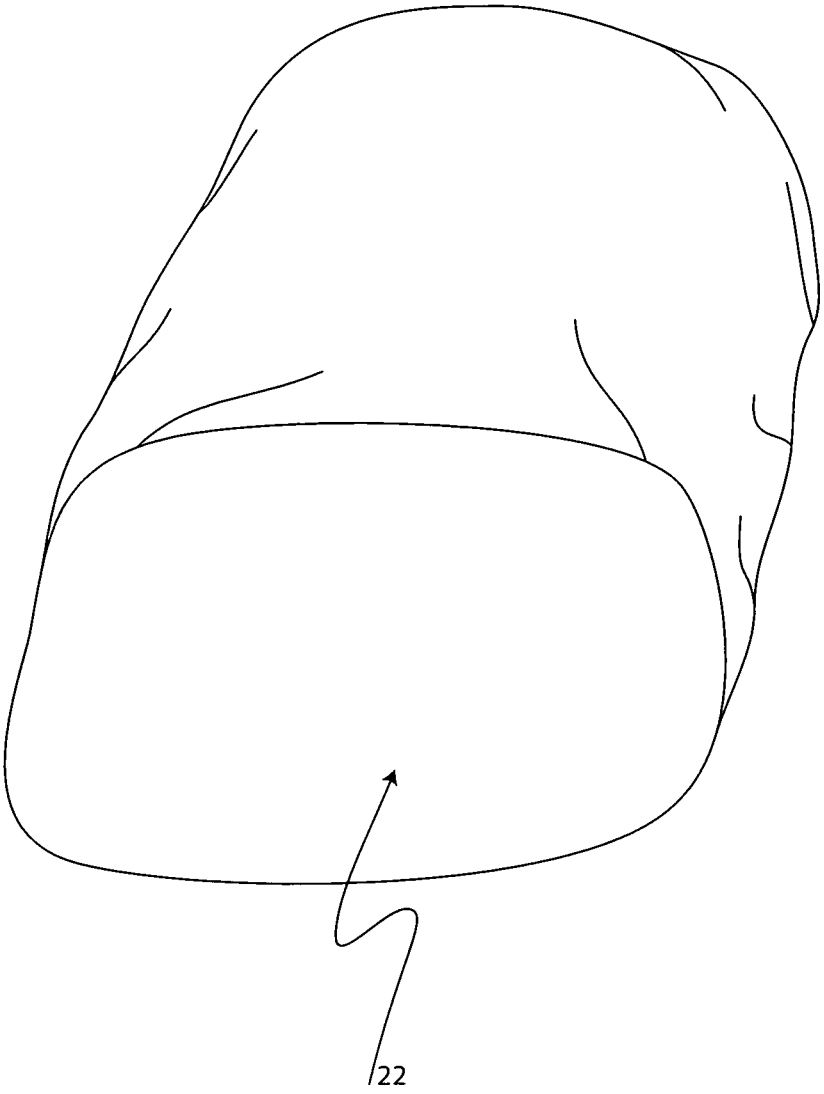
FIG. 6 provides the same from a bottom-up perspective.

The best mode for carrying out the invention is presented in terms of its preferred embodiment, herein depicted within the Figures. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

It should also be understood that, unless a term is expressly defined in this patent there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112(f).

The best mode for carrying out the invention is presented in terms of its preferred embodiment, herein depicted within the Figures.

1. Detailed Description of the Figures

Referring now to the drawings, wherein like reference numerals indicate the same parts throughout the several views, a weather-resistant outdoor dryer, generally noted as 10, is shown according to the preferred embodiment of the present invention. The dryer 10 consists essentially of: a simulated rock cabinet enclosure assembly 12; and a dryer appliance 14 integrated within the enclosure 12.

The simulated rock cabinet enclosure assembly 12 is formed to provide an overall outer appearance consistent with that of a landscaping hardscape element such as a boulder 16. According to one embodiment of the present invention, the boulder 16 may be formed of a molded, hollow simulated stone cabinet or enclosure 12, having an opening 20 at the bottom of the cabinet or enclosure 12. The hollow cabinet 12 is formed with a relatively large cavity or chamber 22 which is characterized by forming an internal appliance containment well 24 within which the dryer appliance 14 is mounted.

The formation of the rock cabinet enclosure assembly 12 may be formed of a molding process in which a model is generated having an appearance of a rock or landscaping boulder, but having a flat lower surface 26 for self-standing support. A female mold may then be poured about a convex outer surface of the model. An appliance access port 30 is formed at a vertical surface of the assembly 12 to provide fluid communication with the internal appliance containment well 24. The appliance access port 30 may be formed.

According to a first envisioned embodiment the female mold may be used to cast an assembly blank through which a fixture creating the appliance access port 30 is indexed to provide an opening of a desired size and location. According to a second envisioned embodiment the assembly blank is formed first and the appliance access port 30 is machined or otherwise formed by a secondary operation.

The assembly blank may be formed of a thermoplastic resin selected and processed in order to provide an outer appearance that would pass as being a solid rock or boulder element.

According to a second envisioned method, the assembly blank may alternately be formed by casting a stone aggregate that provides the appearance of natural stone product. Various casting mixtures may be employed in the formation of the molded simulated appliance cabinet or enclosure 12. Cementious mixtures may be made of various hydrolytic cements i.e.; Hydrostone®, Portland cement mixed with water and fiber glass binder and alkali proof mineral stains may be mixed with water, with the mixtures poured into the female mold and allowed to set. Hydrostone® is a hydraulic cement manufactured by the United States Gypsum Corporation under that trade designation. The pigmentation of the simulated stone may be achieved by use of color batch mixtures poured into the mold cavity and allowed to mix. Further, a dusting of the inside of the rubber inner mold 36 with mica, glass, etc., may be effected or by adding mica, glass, etc. in with the batch of the Hydrolytic cement. Various surface effects can be given to the cast body.

With the casting of a stone aggregate appliance enclosure typical pigments may be utilized, including black oxide of iron for black pigmentation if desired, for ultramarine, pure and artificial red oxide of mars colors, cobalt blue; for browns, umbers, sienna's -yellow ochre, Raw sienna, mars yellow, iron oxide; for greens, chromium oxide and viridian; and for white, white cement with mineral additions of zinc and titanium oxide, marble dust, etc. Additionally, any synthetic acid and alkali proof dyes or additives may be employed. The concrete mixture may include color additive up to 10% of its volume and the colors are mixed first with water to create a slurry and then added to the batch of Hydrolytic cement. In the casting of cementious materials, such as that just previously describe. It should be noted that the casting procedure is basic to all casting materials using alternative materials such as magnesite cement, or acrylic. In the magnesite cement method, variously called plastic magnesia, calcite magnesite, caustic magnesite and lite burned magnesite may be employed. A mixture is made, for example, by mixing a calcite magnesite with liquid magnesium chloride in addition to cement colors and glass and marble chips (and or other inert material). This provides a finished, molded appearance which is marble like and translucent and is employed in the duplication of igneous and metamorphic stone.

According to a third envisioned method, the molding process is rendered mute by forming an assembly blank alternately from a natural stone element that is machined or otherwise worked to form the internal appliance containment well 24 and the appliance access port 30.

Once the enclosure 12 is formed a dryer appliance 14 integrated within the enclosure 12. The dryer appliance 14 may generally be similar to otherwise commercially available designs have features and functions for the drying of clothes. It is preferred that a front-load configuration be utilize sch that the dryer access door 40 is aligned with and is positioned through the appliance access port 30.

2. Operation of the Preferred Embodiment

In operation, the present invention may be positioned outdoors, preferably by the beach or near a public or private pool. When not in operation the enclosure 12 blends in aesthetically with the landscaping or hardscaping around the area. However, the appliance 14 may be accessed in order to dry pool towels and similar articles, on site, rather than collecting used towels and transporting them to another area to be laundered.

The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but is to be accorded the full scope consistent with the language claims and to encompass all legal equivalents. Notwithstanding, none of the claims are intended to embrace subject matter that fails to satisfy the requirement of 35 U.S.C. §101, 102, or 103, nor should they be interpreted in such a way. Any unintended embracement of such subject matter is hereby disclaimed.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

Having thus described the invention what is claimed as new and desired to be secured by Letters Patent is as follows:

1. A weather-resistant outdoor dryer consisting essentially of:

a simulated rock cabinet enclosure assembly; and a dryer appliance integrated within the enclosure assembly;

wherein said simulated rock cabinet enclosure assembly is formed to provide an overall outer appearance of a landscaping hardscape element, rock or boulder.

2. The weather-resistant outdoor dryer of claim 1, wherein simulated rock cabinet enclosure assembly is formed of a molded, hollow simulated stone cabinet or enclosure forming an opening at a bottom and forming a hollow internal appliance containment well within which the dryer appliance is operationally mounted.

3. The weather-resistant outdoor dryer of claim 1, wherein said simulated rock cabinet enclosure assembly is formed of a thermoplastic resin selected and processed in order to provide an outer appearance that would pass as being a solid rock or boulder element.

4. The weather-resistant outdoor dryer of claim 1, wherein said simulated rock cabinet enclosure assembly is formed by casting a stone aggregate that provides the overall outer appearance as a natural stone product.

5. The weather-resistant outdoor dryer of claim 1, wherein said simulated rock cabinet enclosure assembly is formed from a natural stone element that worked to form an internal appliance containment well and a connecting appliance access port.

6. The weather-resistant outdoor dryer of claim 2, wherein said simulated rock cabinet enclosure assembly is formed of a thermoplastic resin selected and processed in order to provide an outer appearance that would pass as being a solid rock or boulder clement.

7. The weather-resistant outdoor dryer of claim 2, wherein said simulated rock cabinet enclosure assembly is formed by casting a stone aggregate that provides the overall outer appearance as a natural stone product.

8. The weather-resistant outdoor dryer of claim 2, wherein said simulated rock cabinet enclosure assembly is formed from a natural stone element that worked to form the internal appliance containment well and a connecting appliance access port.

9. The weather-resistant outdoor dryer of claim 2, wherein said dryer appliance is formed in a front-load configuration in which a dryer access door is aligned with and is positioned through a connecting appliance access port.

10. The weather-resistant outdoor dryer of claim 3, wherein said dryer appliance is formed in a front-load configuration in which a dryer access door is aligned with and is positioned through a connecting appliance access port.

11. The weather-resistant outdoor dryer of claim 4, wherein said dryer appliance is formed in a front-load configuration in which a dryer access door is aligned with and is positioned through a connecting appliance access port.

12. The weather-resistant outdoor dryer of claim 5, wherein said dryer appliance is formed in a front-load configuration in which a dryer access door is aligned with and is positioned through the connecting appliance access port.

* * * * *